US006170286B1

(12) United States Patent
Keuper

(10) Patent No.: US 6,170,286 B1
(45) Date of Patent: Jan. 9, 2001

(54) OIL RETURN FROM REFRIGERATION SYSTEM EVAPORATOR USING HOT OIL AS MOTIVE FORCE

(75) Inventor: Edward F. Keuper, La Crosse, WI (US)

(73) Assignee: American Standard Inc., Piscataway, NJ (US)

( * ) Notice: Under 35 U.S.C. 154(b), the term of this patent shall be extended for 0 days.

(21) Appl. No.: 09/351,035

(22) Filed: Jul. 9, 1999

(51) Int. Cl.[7] ..... F25B 43/02

(52) U.S. Cl. ..... 62/471; 62/84; 62/113; 62/513

(58) Field of Search ..... 62/468, 469, 470, 62/471, 472, 513, 113, 84

(56) References Cited

U.S. PATENT DOCUMENTS

| | | | | |
|---|---|---|---|---|
| 1,899,378 | * | 2/1933 | Zouck et al. | 62/471 X |
| 3,379,030 | | 4/1968 | Garner | 62/192 |
| 3,563,051 | | 2/1971 | Baumgartner | 62/468 |
| 3,856,493 | * | 12/1974 | Bulkley | 62/470 X |
| 4,715,196 | | 12/1987 | Sugiura | 62/468 |
| 5,165,248 | | 11/1992 | Sishtla | 62/84 |
| 5,561,987 | * | 10/1996 | Hartfield et al. | 62/471 |
| 5,606,872 | | 3/1997 | Terasaki | 62/471 |
| 5,890,374 | | 4/1999 | Lee | 62/471 |

* cited by examiner

*Primary Examiner*—Harry B. Tanner
(74) *Attorney, Agent, or Firm*—William J. Berer; William O'Driscoll; Peter D. Ferguson

(57) ABSTRACT

Oil is returned from the evaporator to the oil sump in a refrigeration chiller by directing the lubricant-liquid refrigerant mixture found in the chiller evaporator into heat exchange contact with relatively hotter system lubricant as such lubricant flows from the oil sump to the location of its use in the chiller's compressor. The oil flowing from the sump to the compressor rejects sufficient heat to the lubricant-liquid refrigerant mixture to induce the percolation thereof, such percolation being sufficiently energetic to cause slugs of the lubricant-liquid refrigerant mixture to be delivered from the location of heat exchange into the chiller's lubricant sump thereby effecting the return of oil from the evaporator for re-use in the compressor.

32 Claims, 1 Drawing Sheet

OIL RETURN FROM REFRIGERATION SYSTEM EVAPORATOR USING HOT OIL AS MOTIVE FORCE

BACKGROUND OF THE INVENTION

The present invention relates generally to refrigeration systems. More particularly, the present invention relates to compressor-driven refrigeration chillers in which at least some lubricant tends to make its way from the system compressor to the system evaporator during the course of chiller operation. With still more particularity, the present invention relates to apparatus and a method by which to return oil from the evaporator to the compressor in a refrigeration chiller using hot compressor oil as the motive force for accomplishing oil return.

The migration of lubricant from the compressor to the evaporator in a compressor-driven refrigeration chiller is an age old problem. A very large number of systems, apparatus, methods and schemes have been used and/or suggested to accomplish the return of such oil from the evaporator of a chiller, where it settles on or into the liquid refrigerant pool found therein, back to the chiller's compressor, where it is needed for lubrication. Many of such systems/schemes employ the use of an eductor which draws oil-rich liquid from the system evaporator using a pressurized fluid sourced from elsewhere within the chiller system as the motive force by which the eductor is powered.

More recently, evaporators of the so-called falling film type have begun to be employed in refrigeration chillers, such evaporators being more efficient in terms of the vaporization process that occurs therein. Falling film evaporators operate such a large majority of the refrigerant that enters the evaporator is vaporized within the evaporator shell before having a chance to pool in liquid form in the bottom thereof. This results in the development of a more concentrated and homogenous oil-rich pool of fluid at the bottom of the evaporator shell, such pool being relatively much shallower than the liquid pools in so-called flooded evaporators where the majority of the tubes in the evaporator's tube bundle are bathed in liquid refrigerant at the top of which an oil-rich mixture is found.

One oil return arrangement employed in refrigeration chillers having falling film evaporators is the one described in U.S. Pat. No. 5,761,914, assigned to the assignee of the present invention and incorporated herein by reference, which teaches the use of a so-called "flush"-type oil return system. Other than eductors/ejectors and flush-type systems, mechanical arrangements of still other and different kinds have been employed to induce or accomplish oil return from the evaporator to the compressor in a refrigeration chiller system. Many such systems are relatively difficult and/or expensive to manufacture and/or control but accomplish oil return nonetheless. Each of such systems brings with it various negative attributes, difficulties, failure modes and expense that detract from their attractiveness with respect to the oil return process.

The need continues to exist for an improved lubricant return system in a refrigeration chiller which efficiently returns lubricant from the system evaporator to the system compressor in a reliable yet simple and inexpensive manner.

SUMMARY OF THE INVENTION

It is an object of the present invention to cause the return of oil from an evaporator to the compressor in a refrigeration chiller.

It is another object of the present invention to provide for the return of system lubricant from the evaporator to the compressor in a refrigeration chiller by the use of heat which exists in the chiller system.

It is a still further object of the present invention to provide for the return of lubricant from the evaporator to the compressor in a refrigeration chiller by the transfer of heat from a first substance within the chiller to the mixture of oil and liquid refrigerant found within the system evaporator when the chiller is in operation, the addition of such heat to the oil-rich mixture causing, in turn, the beneficial cooling of the substance which is the source of such heat.

It is another object of the present invention to provide for the return of lubricant from the evaporator to the compressor in a refrigeration chiller by the method of percolation.

It is an additional object of the present invention to return oil to the compressor in a refrigeration chiller from the location or locations within the chiller's evaporator where the concentration of oil in the pooled mixture of oil and liquid refrigerant found therein is highest.

It is still another object of the present invention to provide for the return of lubricant from the evaporator to the compressor in a refrigeration chiller using a process/methodology which is generally fail-safe and is a byproduct of system operation, yet which does not require the use of mechanical or electromechanical apparatus, valving or controls dedicated to or associated with the oil return process.

Finally, it is a specific object of the present invention to induce the return of the oil-rich mixture found in the evaporator of a refrigeration chiller to the chiller's compressor and/or its sump by placing hot oil, sourced from the chiller's oil sump, in heat exchange contact with the oil-rich mixture found in the system evaporator so as to induce the percolation thereof, the rejection of heat from the hot oil to the oil-rich evaporator mixture beneficially cooling the oil enroute to its use to lubricate the bearing surfaces of the chiller's compressor.

These and other objects of the present invention, which will be appreciated when the following Description of the Preferred Embodiment and attached Drawing Figures are considered, are accomplished by bringing hot system lubricant, pumped from the oil sump of the compressor of a refrigeration chiller in the normal process of its delivery to compressor bearing surfaces, into heat exchange contact with (i) the oil-rich mixture found generally at the surface of the liquid pool in a flooded evaporator or (ii) with the oil-rich mixture that resides at the bottom of an evaporator of the falling film type. The heat of the compressor lubricant pumped from the chiller's oil sump is rejected to the oil-rich evaporator mixture at a location exterior of the evaporator. The heating of the evaporator mixture at such location causes a portion of the refrigerant within the oil-rich mixture to vaporize/boil which, in turn, causes the mixture to percolate. Percolation of the mixture has the effect of raising slugs of the oil-rich evaporator mixture from the location of heat exchange into the compressor's oil sump, the net result being the return of lubricant from the evaporator to the chiller's oil sump where it becomes available for re-use in the lubrication of the chiller's compressor. The rejection of heat from the oil which is pumped from the oil sump into the oil-rich evaporator mixture not only causes percolation of the oil-rich mixture to accomplish oil return but cools the oil enroute to the bearings of the system compressor which is beneficial in terms of the ability of such oil to reliably carry out its compressor bearing lubrication function.

DESCRIPTION OF THE DRAWING FIGURES

DESCRIPTION OF THE PREFERRED EMBODIMENT

Figures 1, 2, 3:
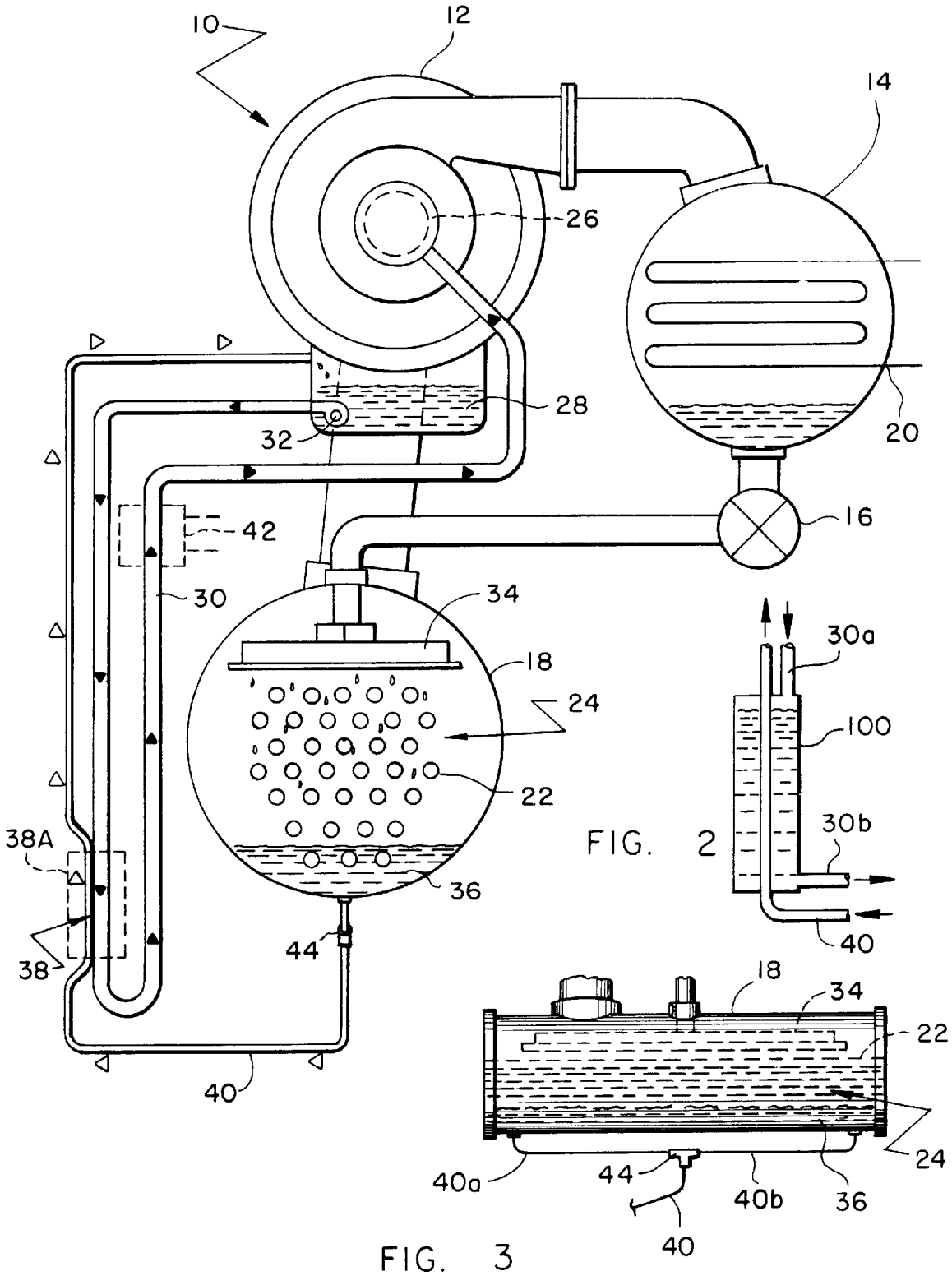
FIG. 1 is a schematic illustration of the refrigeration chiller of the present invention illustrating the oil-return process and the apparatus associated with it.
FIG. 2 illustrates an alternate oil-cooling heat exchange arrangement to the one of the preferred embodiment of FIG. 1.
FIG. 3 is a side view of the evaporator of the preferred embodiment of the present invention illustrating the locations at which the oil-rich mixture is drawn there out of due to the relatively higher concentration of oil in the liquid mixture found at such locations.

Referring first to FIG. 1, refrigeration chiller 10 includes a compressor 12, a condenser 14, an expansion device 16 and an evaporator 18, all of which are connected for serial flow to form a refrigeration circuit. Compressor 12, in the preferred embodiment, is a compressor of the centrifugal type. In operation, compressor 12 compresses a refrigerant-gas, heating it and raising its pressure in the process, and delivers such refrigerant as a hot, high pressure gas to condenser 14.

The gaseous refrigerant delivered into condenser 14 is condensed to liquid form by heat exchange with a cooling fluid, such as water, which flows through tube bundle 20. In some types of chillers, ambient air, as opposed to water, is used as the cooling fluid. The condensed refrigerant, which is still relatively hot and at relatively high pressure, flows from condenser 14 to and through expansion device 16. In the process of flowing through expansion device 16, the condensed refrigerant undergoes a pressure drop which causes at least a portion thereof to flash to refrigerant gas and, as a result, causes the refrigerant to be cooled.

The now cooler two-phase refrigerant is delivered from the expansion device into the interior of evaporator 18 where it is brought into heat exchange contact with a heat exchange medium, most typically water, flowing through individual tubes 22 of tube bundle 24. The heat exchange medium flowing through tube bundle 24, having been heated by the heat load which it is the purpose of the chiller to cool, is warmer than the refrigerant it is brought into heat exchange contact with and rejects heat thereto. The refrigerant is thereby warmed and the majority of the liquid portion of the refrigerant vaporizes.

The medium flowing through the tube bundle is, in turn, cooled and is delivered back to the heat load which may be the air in a building, a heat load associated with a manufacturing process or any heat load which it is necessary or beneficial to cool. After cooling the heat load, the medium is returned to the evaporator, once again carrying heat from the heat load, where it is again cooled by refrigerant in an ongoing process. The refrigerant vaporized in evaporator 18 is drawn thereoutof by compressor 12 which re-compresses it and delivers it to condenser 14, likewise in a continuous and ongoing process.

Virtually all refrigeration chiller compressors employ or require the use of rotating parts to accomplish their compression purpose. Such rotating parts will, as is the case with virtually all rotating machinery, be carried in bearings, such as bearing 26, which will require lubrication. In the preferred embodiment, bearing 26 is lubricated by oil which is pumped from sump 28, through line 30 by pump 32. Typical also of most refrigeration chillers is the fact that at least some of the oil used to lubricate the bearings thereof will make its way into the refrigeration circuit as a result of its becoming entrained in the refrigerant gas that is discharged from the system's compressor.

The lubricant entrained in the stream of refrigerant gas delivered from the compressor to the condenser in a chiller system falls to the bottom of the condenser and flows, with the condensed system refrigerant, to and through the system expansion device. Such lubricant is then carried into the system evaporator where it most typically ends up pooled at the bottom thereof, together with any liquid refrigerant that is not immediately vaporized by the heat exchange process ongoing with the evaporator. In the case of a flooded evaporator, the lubricant may concentrate at and float on the top of the liquid pool found in the evaporator shell. In a falling film evaporator, the liquid pool at the bottom of the evaporator is relatively shallow and the concentration of lubricant therein will be relatively high and fairly consistent throughout. Such pooled mixture of oil and liquid refrigerant is indicated by numeral 36 in FIG. 1.

It is to be noted that evaporator 18, in the preferred embodiment, is an evaporator of the falling film type which employs a refrigerant distributor 34. While evaporator 18 is a falling film evaporator in the context of the preferred embodiment of the present invention, the present invention is not limited to use therewith and has application in chiller systems employing evaporators of other types. Likewise, the present invention has application to chiller systems which employ compressors other than those of the centrifugal type and which may or may not employ pumps, such as pump 32, to deliver oil from an oil sump to compressor bearing surfaces. Such other systems may, for example, employ compressors of the scroll, screw or other types.

Because the evaporator in a refrigeration chiller is the lowest pressure location in the chiller when the chiller is in operation and because vaporized refrigerant is typically drawn out of a chiller evaporator from the upper portion thereof, lubricant which makes its way into the evaporator of a refrigeration chiller and which pools at the bottom thereof will tend to accumulate and remain there. If such lubricant is not returned to the chiller's compressor and/or its oil sump, the compressor will eventually become starved for lubricant and catastrophic failure thereof will occur.

Still referring to FIG. 1, and as has been noted, compressor bearing 26 is lubricated by oil which is delivered to it from oil sump 28 through oil supply line 30 by pump 32 and evaporator 18 is of the falling film type. Because evaporator 18 is of the falling film type, the mixture 36 that will be found in liquid form at the bottom of the evaporator will be relatively shallow and will be relatively oil-rich, though the majority of it will be liquid refrigerant.

Because evaporator mixture 36 is oil-rich but, nonetheless, contains liquid refrigerant at relatively low temperature and pressure, should mixture 36 be heated, the refrigerant portion thereof will tend to boil/vaporize, causing the relatively violent bubbling and percolation of that mixture at the location where heat is added to it. Such percolation, if sustained, can be sufficiently energetic/violent to result in the upward vertical movement of slugs of the oil-rich evaporator mixture from the location where heat is added to it.

In the preferred embodiment, mixture 36 flows by force of gravity from evaporator 18 to the location 38 where heat is added to it for oil return purposes. It will be appreciated, however, that such mixture could be caused to move to the location of heat exchange by means other than gravity, such as by use of an eductor or pump. The use of an eductor or pump for such purpose would, of course, complicate, add expense to and possibly result in failure modes that do not exist when gravity is used for that purpose.

In the preferred embodiment, heat exchange for oil return purposes is between relatively hot oil pumped out of oil sump 28 by pump 32 through line 30 and the portion of oil-rich mixture 36 which is delivered by gravity to heat exchange location 38 from evaporator 18. Heat exchange at location 38 is, in the preferred embodiment, occasioned by the physical contact of line 40, through which mixture 36 is returned from evaporator 18 to the compressor's oil sump 28, and line 30, through which hot compressor lubricant is pumped from sump 28. As will be appreciated, such heat exchange is accomplished at relatively very little expense and with little or no complication other than in bringing the two lines into contact for heat exchange through their respective walls.

In that respect, it will be appreciated that heat exchange location 38 is, in effect, a heat exchanger, though not a discrete heat exchanger component. As will be appreciated, however, a discrete heat exchanger, such as heat exchanger 38A, shown in phantom in FIG. 1, could be interposed in lines 30 and 40 for the purpose of causing the heat exchange described herein. The use of a discrete heat exchanger component has been found not to be necessary and, as will also be appreciated, a discrete heat exchanger would, if employed, add expense to the chiller in terms of both its material cost and fabrication expense.

As had been noted above, evaporator 18 is a low pressure location within chiller 10 and because evaporator 18 is a low-pressure location within chiller 10 a pressure differential cannot be counted on to motivate the flow of the oil-rich mixture that exists in evaporator 18 back to sump 28 for oil return purposes whereas the temperature differential and heat exchange contact described above can.

As a result of such contact, heat from the oil being pumped from sump 28 to the bearings it lubricates is rejected into the oil-rich mixture that exists in oil return line 40 at location 38 in sufficient quantity to induce percolation in that oil-rich mixture found at location 38 within line 40 in the absence of a pressure differential and with sufficient energetic effect to cause slugs of the liquid mixture to flow into the sump.

As has been mentioned, a beneficial side result of such heat exchange is the cooling of oil prior to its delivery to the compressor bearings it lubricates. In most instances, however, such oil cooling, while beneficial, will be supplemented by the use of a separate oil cooling arrangement, such as oil cooler 42 which is illustrated in phantom in FIG. 1.

As will be appreciated, various other apparatus/methodologies for placing mixture 36 in heat exchange contact with the relatively hot oil pumped from sump 28 are contemplated and fall within the scope of this invention. One such arrangement might involve the use of a tube-in-tube heat exchange arrangement of the type illustrated in FIG. 2. In that regard and referring additionally now to FIG. 2, line 40 is illustrated as a continuous line around which a closed tubular member 100 is disposed. Pump 32 delivers relatively hot lubricant from sump 28 through portion 30*a* of line 30 into the interior of tubular member 100 which fills with hot oil. The hot oil is placed in direct heat exchange contact with the exterior of oil return line 40 in which the oil-rich evaporator mixture will be found. Oil continuously flows through tubular member 100, when the chiller is in operation, causing percolation of mixture 36 in line 40 and the raising of slugs thereof into sump 28. Such oil then flows thereoutof through portion 30*b* of line 30 to the compressor bearing location. Still other arrangements for bringing hot compressor oil into heat exchange contact with evaporator mixture 36 are contemplated and fall within the scope of the present invention.

Also contemplated is the addition of heat, other than from compressor oil, to induce percolation for the purpose of returning oil from the evaporator to the oil sump in a refrigeration chiller. Such heat, in theory, could be supplied by system refrigerant, possibly sourced from the condenser, or by apparatus such as electrical heat tape wrapped around line 38. In that respect, the present invention, in its broadest sense, resides in the application of heat to the oil-rich evaporator mixture 36 to induce the percolation therein for the return of oil to the oil sump of a refrigeration chiller. In its preferred embodiment, however, the source of heat by which such percolation is induced is the relatively hot oil that will be found in a chiller's oil sump when the chiller is in operation.

Referring additionally now to FIG. 3, a side view evaporator 18 is illustrated. The two-phase refrigerant mixture delivered into evaporator 18 from expansion valve 16 is deposited in droplet form by distributor 34 onto tube bundle 24. As will be appreciated from FIGS. 1 and 3, distributor 34 overlies the majority of the length and width of tube bundle 24.

A phenomenon has been noted to occur in evaporators and, in particular, in evaporators of the falling film type with respect to the pool of liquid refrigerant and oil found at the bottom thereof. In that regard, because some of the individual tubes 22 of tube bundle 24 in evaporator 18 are immersed in mixture 36, the medium flowing therethrough will vary in temperature during the course of its flow through such tubes as its heat is rejected to the system refrigerant. As a result and because distributor 34 will inherently not be "perfect" in its distribution of refrigerant across the length and width of the evaporator tube bundle, the oil-rich mixture 36 that pools at the bottom of the evaporator will be found to have temperature gradients throughout its length, width and depth. As a result thereof, it has been found that some oil migration and flow will occur within mixture 36 itself within the evaporator shell. As a result of this internal oil migration within mixture 36 internal of the evaporator shell, it is found that oil within mixture 36 will tend to still further concentrate and be somewhat higher at certain locations within the evaporator shell.

In the evaporator of the preferred embodiment, oil concentration within mixture 36, while generally consistent, is found to be highest at the ends of the evaporator shell. Therefore, for purposes of optimizing oil return, the mixture that is drawn out of evaporator 18 for return to oil sump 28 is, in the preferred embodiment, drawn from both of its ends, where the concentration of oil in mixture 36 is found to be at its highest. As such, the oil-rich mixture within evaporator 18 is drawn from two locations in the preferred embodiment through lines 40*a* and 40*b* which join at tee 44 to form line 40. By drawing the oil-rich mixture 36 from of evaporator 18 at the one or more locations in the evaporator where oil concentration in the mixture is at its highest, the efficiency of the oil return process is enhanced as is the overall reliability of chiller 10. It is to be noted that the sizes/diameters of lines 30 and 40 will depend upon the nature of the chiller system. In systems where there is relatively little oil carryover into the system evaporator and where carryover is slow, the line sizes can be relatively quite small, on the order of one-half inch or less in each case.

While the preferred invention has been described in terms of preferred and certain alternative embodiments, it will be appreciated that there are many others thereof which fall within its scope and which will be apparent to those skilled in the art given the teachings herein.

What is claimed is:

1. A refrigeration chiller comprising:

a compressor;

a condenser;

an expansion device;

an evaporator, said compressor, said condenser, said expansion device and said evaporator being connected to form a refrigeration circuit;

a lubricant sump;

a first line through which lubricant is delivered from said sump to a location in said compressor;

apparatus for causing the movement of lubricant from said sump through said first line; and a second line, said second line being in flow communication with a location in said evaporator to which lubricant migrates during chiller operation, said migrated lubricant mixing with liquid refrigerant in said evaporator to form a lubricant-liquid refrigerant mixture, said second line and said first line being disposed in a heat exchange relationship such that lubricant flowing through said first line rejects heat to lubricant-liquid refrigerant mixture in said second line in sufficient quantity to induce the flow of at least a portion of said lubricant-liquid refrigerant mixture through said second line and to said sump in the absence of a pressure differential between said evaporator and said lubricant sump.

2. The refrigeration chiller according to claim 1 wherein lubricant-refrigerant mixture induced to flow through said second line is delivered into to said lubricant sump.

3. The refrigeration chiller according to claim 2 wherein said heat exchange relationship between said first and said second lines is achieved by the physical contact of said lines and wherein said physical contact is at a location exterior of said evaporator.

4. The refrigeration chiller according to claim 3 wherein said location of physical contact is a location to which said lubricant-refrigerant mixture flows from said evaporator by force of gravity.

5. The refrigeration chiller according to claim 4 wherein said evaporator is a falling film evaporator and wherein said second line opens into said evaporator at a location where the concentration of lubricant in said lubricant-liquid refrigerant mixture is relatively higher than the concentration of lubricant in said mixture at another location in said evaporator.

6. The refrigeration chiller according to claim 5 further comprising apparatus for cooling lubricant flowing through said first line at a location downstream of the location at which fluid flowing through said first line is initially cooled by its rejection of heat to the lubricant-liquid refrigerant mixture in said second line.

7. The refrigeration chiller according to claim 4 wherein said second line opens into said evaporator at more than one location, each of said locations being locations where the concentration of lubricant in said lubricant-liquid refrigerant mixture is relatively and generally higher than the concentration of lubricant in said mixture at other locations in said evaporator.

8. The refrigeration chiller according to claim 2 wherein at least a portion of one of said first and said second lines runs internal at least a portion of the other of said first and said second lines where heat is rejected from the lubricant flowing through said first line to lubricant-liquid refrigerant mixture in said second line, the fluid flowing through the one of said first and said second lines internal of which the other of said first and said second lines runs being in direct heat exchange contact with the exterior of the internal line.

9. The refrigeration chiller according to claim 2 wherein the location at which said first and said second lines are in a heat exchange relationship is exterior of said evaporator and at a location to which said lubricant-liquid refrigerant mixture flows from said evaporator by force of gravity.

10. The refrigeration chiller according to claim 8 wherein said first and said second lines are in physical contact with each other at the location of heat exchange between lubricant flowing through said first line and lubricant-liquid refrigerant mixture in said second line.

11. The refrigeration chiller according to claim 2 further comprising a heat exchanger, said heat exchanger being interposed in said first and said second lines and being the location of said heat exchange relationship between lubricant flowing through said first line and lubricant-liquid refrigerant mixture in said second line.

12. A refrigeration chiller comprising:

a compressor, said compressor having oil delivered to it during chiller operation;

a condenser;

an expansion device;

an evaporator, said compressor, said condenser, said expansion device and said evaporator being connected to form a refrigeration circuit, a portion of the oil delivered to said compressor during the course of chiller operation making its way into said evaporator, said oil mixing with liquid refrigerant in said evaporator to form an oil-liquid refrigerant mixture;

an oil sump, said oil sump being the location from which oil is delivered to said compressor; and a heat exchanger to which oil from said sump and oil-liquid refrigerant mixture from said evaporator flows, heat from said oil being rejected to said oil-liquid refrigerant mixture in said heat exchanger in sufficient quantity to cause slugs of said oil-liquid refrigerant mixture to move from said heat exchanger into said oil sump in the absence of a pressure differential between said evaporator and said lubricant sump.

13. The refrigeration chiller according to claim 12 wherein said oil sump is located vertically above the level of said oil-liquid refrigerant mixture in said evaporator.

14. The refrigeration chiller according to claim 13 wherein the flow of oil from said sump through to said heat exchanger is in the course of the flow of said oil to the location of its use in said compressor.

15. The refrigeration chiller according to claim 14 further comprising a first line through which oil flows from said sump to the location of its use in said compressor and a second line communicating between a location in said evaporator where said oil-liquid refrigerant mixture is found and said oil sump, said heat exchanger comprising the physical contact of said first and said second lines.

16. The refrigeration chiller according to claim 15 wherein the location of physical contact between said first and said second lines is generally at or below the level from which said oil-liquid refrigerant mixture flows out of said evaporator through said second line enroute to said heat exchanger so that the flow of said oil-liquid refrigerant mixture to said location is gravity assisted.

17. The refrigeration chiller according to claim 16 wherein said oil-liquid refrigerant mixture is drawn from said evaporator from a location where the concentration of oil in said oil-liquid refrigerant mixture in said evaporator is gene rally higher than the concentration of oil that will be found in said mixture in other locations in said evaporator.

18. Apparatus in a refrigeration chiller for causing the movement of a lubricant-liquid refrigerant mixture from the evaporator of this chiller to a lubricant sump in said chiller so as to make such lubricant available for use in the chiller's compressor comprising:

a first line, said first line communicating between said sump and said compressor and through which lubricant flows from said sump to said compressor when said chiller is in operation; and a second line, said second line communicating between said evaporator and said sump, said lubricant-liquid refrigerant mixture flowing into said second line when said chiller is in operation, the temperature of the lubricant-liquid refrigerant mixture flowing into said second line being lower than the temperature of lubricant flowing through said first line, said first line and said second line being in a heat exchange relationship so that lubricant flowing through said first line rejects heat to the lubricant-liquid refrigerant mixture in said second line in sufficient quantity to cause at least a portion of the liquid refrigerant in said lubricant-liquid refrigerant mixture to vaporize with sufficient energetic effect to cause slugs of said lubricant-liquid refrigerant mixture to be delivered from the location of said heat exchange in to said sump in the absence of a pressure differential between said evaporator and said lubricant sump.

19. The apparatus according to claim 18 wherein said first and said second lines are brought into physical contact with each other in order to facilitate said heat exchange.

20. The apparatus according to claim 19 wherein said physical contact of said first and said second lines is at or below the location in said evaporator where said lubricant-liquid refrigerant mixture enters said second line.

21. The apparatus according to claim 20 wherein said second line opens into said evaporator at one or more locations where the concentration of oil in the mixture of lubricant and liquid refrigerant in said evaporator is generally higher than in other locations within said evaporator.

22. The apparatus according to claim 18 further comprising a heat exchanger, said heat exchanger being interposed in both said first and said second lines, lubricant flowing through said first line being brought into heat exchange contact within said heat exchanger with lubricant-liquid refrigerant mixture delivered into said heat exchanger through said second line.

23. A refrigeration chiller comprising:

a compressor;

a condenser;

an expansion device;

an evaporator to which oil migrates from said compressor when said chiller is in operation, said migrated oil mixing with liquid refrigerant in said evaporator to form an oil-liquid refrigerant mixture, said compressor, said condenser, said expansion device and said evaporator being connected to form a refrigeration circuit;

an oil sump;

a hot fluid disposed in said chiller, the temperature of said fluid being higher than the temperature of said oil-liquid refrigerant mixture;

an oil return line, said oil return line communicating between said evaporator and said sump, said line being configured so that said oil-refrigerant mixture flows from said evaporator thereinto; and a heat exchanger, said heat exchanger bringing said hot fluid into heat exchange contact with the oil-refrigerant mixture that flows into said oil return line so as to induce the percolation of that mixture with sufficient effect to cause slugs of that mixture to move out of said oil return line into said sump in the absence of a pressure differential between said evaporator and said oil sump.

24. The refrigeration chiller according to claim 23 wherein said hot fluid is one of lubricant flowing from said sump or refrigerant flowing within said refrigeration circuit.

25. The refrigeration chiller according to claim 24 wherein said hot fluid is oil flowing from said sump.

26. The refrigeration chiller according to claim 25 further comprising oil supply line, said heat exchanger comprising a portion of said oil supply line and a portion of said oil return line, said portions of said oil supply line and said oil return line being in physical contact to effect the rejection of heat from oil flowing through said oil supply line to the oil-liquid refrigerant mixture in said oil return line at the location of physical contact.

27. A method for returning oil from the evaporator to the sump of a compressor in a refrigeration chiller comprising the steps of:

collecting a mixture of oil and liquid refrigerant in said evaporator;

flowing said mixture to a location external of said evaporator; and heating said mixture, at said location external of said evaporator, so as to cause said mixture to percolate with sufficient energetic effect to cause the flow of at least a portion thereof to said sump in the absence of a pressure differential between said evaporator and said sump.

28. The method according to claim 27 wherein said flowing step includes the step of delivering said mixture to the location at which it is heated in said heating step through a line that communicates between said evaporator and said sump.

29. The method according to claim 28 comprising the further step of delivering oil from said sump to said compressor and wherein said heating step includes the step of bringing oil delivered to said compressor in said delivering step into heat exchange contact with said mixture in a manner such that the oil both rejects heat to said mixture to cause said percolation and is cooled thereby prior to being delivered to said compressor.

30. The method according to claim 29 wherein said delivering step includes the step of flowing said mixture from said evaporator to the location of heat exchange contact by force of gravity.

31. The method according to claim 30 comprising the further step of cooling said oil subsequent to said bringing step.

32. The method according to claim 28 wherein said flowing step includes the step of drawing said oil-liquid refrigerant mixture from said evaporator at a location where the concentration of oil in said mixture is generally higher than the concentration of oil in said mixture at other locations in said evaporator.

* * * * *